US011739515B2

(12) United States Patent
Ghodrati

(10) Patent No.: US 11,739,515 B2
(45) Date of Patent: Aug. 29, 2023

(54) AUTOMATIC TOILET CLEANER DEVICE

(71) Applicant: Mahdi Ghodrati, Burlington (CA)

(72) Inventor: Mahdi Ghodrati, Burlington (CA)

( * ) Notice: Subject to any disclaimer, the term of this patent is extended or adjusted under 35 U.S.C. 154(b) by 304 days.

(21) Appl. No.: 17/283,726

(22) PCT Filed: Oct. 10, 2019

(86) PCT No.: PCT/CA2019/051450

§ 371 (c)(1),
(2) Date: Apr. 8, 2021

(87) PCT Pub. No.: WO2020/073133

PCT Pub. Date: Apr. 16, 2020

(65) Prior Publication Data

US 2021/0388591 A1 Dec. 16, 2021

Related U.S. Application Data

(60) Provisional application No. 62/917,592, filed on Dec. 18, 2018, provisional application No. 62/766,266, filed on Oct. 11, 2018.

(51) Int. Cl.
*E03D 9/03* (2006.01)

(52) U.S. Cl.
CPC ..... *E03D 9/037* (2013.01)

(58) Field of Classification Search
CPC ..... E03D 9/033; E03D 9/035; E03D 9/037
USPC ..... 4/227.1–227.4; 222/67, 68
See application file for complete search history.

(56) References Cited

U.S. PATENT DOCUMENTS 1,602,554 A * 10/1926 Schrank ..... E03D 9/037 4/227.3
2,620,097 A 12/1952 Titmas
3,341,074 A 9/1967 Pannutti
3,831,205 A 8/1974 Foley
4,208,747 A 6/1980 Dirksing
4,285,074 A * 8/1981 Leinberry ..... E03D 9/037 4/227.3
4,296,503 A 10/1981 Leardi
4,312,082 A 1/1982 Murphy et al.
4,318,891 A 3/1982 Kim
(Continued)

FOREIGN PATENT DOCUMENTS

WO WO-2004016869 A1 * 2/2004 ..... E03D 9/037

OTHER PUBLICATIONS

International Search Report and Written Opinion in PCT/CA2019/051450 dated Jan. 21, 2020.

*Primary Examiner* — Tuan N Nguyen
(74) *Attorney, Agent, or Firm* — Knobbe Martens Olson & Bear LLP

(57) ABSTRACT

An automatic toilet cleaning device for placement inside a cistern of a flush toilet. The device comprises at least a first and second chamber, the second chamber storing a cleaner concentrate, the first chamber formed as a tapered vault. The second chamber having a first end communicative with the first chamber and a second end enclosed by a first barrier defining a gap; a pipe extending from and sealing the gap in the first barrier forming a water channel and a buoyant actuator coupled by a tether to a stopper, the tether disposed in the water channel. In use, as the water levels in the cistern fall and rise, a dosed amount of cleaning solution is released into the cistern.

19 Claims, 9 Drawing Sheets

(56) References Cited

U.S. PATENT DOCUMENTS

| | | | |
|---|---|---|---|
| 4,365,362 | A | 12/1982 | Corey |
| 4,429,809 | A | 2/1984 | Bousgarbies |
| 4,491,988 | A | 1/1985 | Mizuno |
| 4,512,041 | A | 4/1985 | Tsai |
| 4,530,118 | A | 7/1985 | Richards |
| 4,534,070 | A | 8/1985 | Hauptmann et al. |
| 4,534,071 | A | 8/1985 | Russomanno |
| 4,635,302 | A | 1/1987 | Dolan |
| 4,660,231 | A | 4/1987 | McElfresh et al. |
| 4,696,414 | A | 9/1987 | Huat |
| 4,709,424 | A | 12/1987 | Dolan |
| 4,773,103 | A | 9/1988 | Dahlheimer |
| 4,896,382 | A | 1/1990 | Sokol et al. |
| 5,181,281 | A | 1/1993 | Jang |
| 5,611,465 | A | 3/1997 | Lee et al. |
| 5,815,850 | A | 10/1998 | Shon |
| 5,881,396 | A | 3/1999 | Rivera |
| 6,151,722 | A | 11/2000 | Lubrano |
| 6,295,688 | B1 | 10/2001 | Sayles et al. |
| 6,321,392 | B1 | 11/2001 | Sim |
| 6,332,229 | B1 | 12/2001 | O'Malley et al. |
| 6,374,426 | B1 | 4/2002 | Falchieri |
| 6,675,396 | B2 | 1/2004 | Varanasi et al. |
| 6,713,441 | B1 | 3/2004 | Desenna et al. |
| 6,944,890 | B1 | 9/2005 | Sim |
| 7,832,030 | B2 | 11/2010 | Nunez et al. |
| 8,603,257 | B2 | 12/2013 | Burt et al. |
| 8,806,668 | B2 | 8/2014 | Lin et al. |
| 8,987,182 | B2 | 3/2015 | Warkotsch et al. |
| 9,714,507 | B1 | 7/2017 | Snell |
| 9,926,695 | B2 | 3/2018 | Lehmann et al. |
| 2007/0039087 | A1 | 2/2007 | Bringmann |
| 2009/0249533 | A1 | 10/2009 | Sawalski et al. |
| 2015/0128336 | A1 | 5/2015 | Bashan |
| 2018/0216330 | A1 | 8/2018 | Tokarev et al. |

* cited by examiner opened closed

Acute triangle wedge: where the base rectangle is a by b, c is the apex edge length parallel to a, and h the height from the base rectangle to the apex edge.

Triangular prism
(Parallel triangle wedge)

(Obtuse triangle wedge)

AUTOMATIC TOILET CLEANER DEVICE

BACKGROUND OF THE INVENTION

Field of the Invention

The present invention relates to a toilet cleaning device, and more particularly a toilet cleaning device for placement inside a cistern of a flush toilet.

Description of the Related Art

A flush toilet includes a toilet bowl communicative with a flush tube outlet from a water reservoir tank or cistern. The cistern is typically plumbed with an inlet water tube to be filled with either potable water or greywater recycled from washings. A flush event results in removal of contents of a toilet bowl by a water flow force provided by gravitational flow of water from the cistern into the toilet bowl. A flush cycle begins with manipulation of a flush handle of a control lever connected by a chain to a flush valve flapper starting a drop phase of a flush event, with manipulation of the flush handle lifting open the flapper valve and the water of the cistern releasing into the toilet bowl. When the cistern is sufficiently empty the flush valve flapper falls to a closed position starting a rise phase of the flush event. With emptying of water from the cistern a float connected to a fill valve drops with dropping of the float initiating opening of the fill valve to allow water flow from the inlet water tube into the cistern and the toilet bowl. The float rises as water levels rise in the cistern and the toilet bowl. When the float is raised to a predetermined position coordinated with a desired filled water level, the fill valve is triggered to shut off water inflow from the water inlet tube starting a rest phase of a flush cycle until another flush event is initiated.

Many solutions have been provided to supply a cleaning agent or composition to the toilet bowl during a flush cycle to reduce manual cleaning of a clean toilet bowl. For example, a cleaning concentrate formed as a solid cake has been placed in the cistern, with the solid cake dissolving into the water of the cistern during a time interval between flush events. A recognized disadvantage is that the solid cake dissolves too quickly and must be replaced often. To address this disadvantage the solid cake has been placed in a container with an inlet and outlet; however, this approach continues to suffer from too much cake being dissolved and released when the time interval between flush events is relatively long and also requires frequent replacement. Containers with valves to regulate flow of cleaning concentrate have been produced (see for example U.S. Pat. No. 4,660,231 by McElfresh et al., published 28 Apr. 1987), but typically the valves are unprotected so as to be prone to wear and jamming on a typical time scale of 2 to 4 months and resultant hundreds of flush events. Further solutions have been devised that provide a more reliable valve to regulate flow of cleaning concentrate (see for example US Patent Application Publication No. 2015/0128336 by Bashan et al., published 14 May 2015), but the cleaning dispenser is mounted in a complicated arrangement outside of the cistern which is aesthetically unappealing and requires a modification of the cistern that is unlikely to be accepted by consumers. Still further solutions require inline connection to a water flow inlet tube (see for example U.S. Pat. No. 5,815,850 by Shon, published 6 Oct. 1998 or U.S. Pat. No. 6,321,392 by Sim, published 27 Nov. 2001), but the installation is cumbersome and complicated for the common consumer.

Accordingly, there is a continuing need for an alternative toilet cleaning device for a flush toilet.

SUMMARY OF THE INVENTION

In an aspect there is provided, a toilet cleaner device comprising:

a container defining a first chamber and a second chamber, the first chamber communicative with the second chamber, the second chamber storing a cleaner concentrate;

the first chamber formed as a tapered vault defined by a base, an apex and an axis passing through a center of the base and a center of the apex, the tapered vault formed by one or more tapered sidewalls sloping towards the axis of the tapered vault in a direction extending from the base to the apex;

a first inlet communicative with the first chamber, the first inlet formed at or proximal to the apex;

the second chamber having a first end communicative with the first chamber and a second end enclosed by a first barrier defining a gap;

a pipe extending from and sealing the gap in the first barrier, the pipe forming a water channel extending between opposing first and second open ends of the pipe, the first open end located at or proximal to the first end of the second chamber and the second open end located at or proximal to the second end of the second chamber;

a buoyant actuator coupled by a tether to a stopper, the tether disposed within the water channel, the buoyant actuator disposed proximal to the first open end of the pipe and the stopper disposed proximal to the second open end of the pipe.

In another aspect there is provided, a toilet cleaner device comprising:

a container defining a first chamber, a second chamber, and a third chamber, the first chamber communicative with the second chamber, the second chamber communicative with the third chamber through a gap in a first barrier, the second chamber storing a cleaner concentrate;

a first inlet communicative with the first chamber, and a first outlet communicative with the third chamber;

the first chamber formed as a tapered vault defined by a base, an apex and an axis passing through a center of the base and a center of the apex, the tapered vault formed by one or more tapered sidewalls sloping towards the axis of the tapered vault in a direction extending from the base to the apex;

a pipe extending from the gap in the first barrier, the pipe forming a water channel extending between opposing first and second open ends of the pipe, the first open end located proximal to the first chamber and the second open end located proximal to the third chamber, such that the second chamber communicates with the third chamber through the water channel only;

a buoyant actuator coupled by a tether to a stopper, the tether disposed within the water channel, the buoyant actuator disposed proximal to the first open end of the pipe and the stopper disposed proximal to the second open end of the pipe.

DETAILED DESCRIPTION OF PREFERRED EMBODIMENTS

Figure 1:
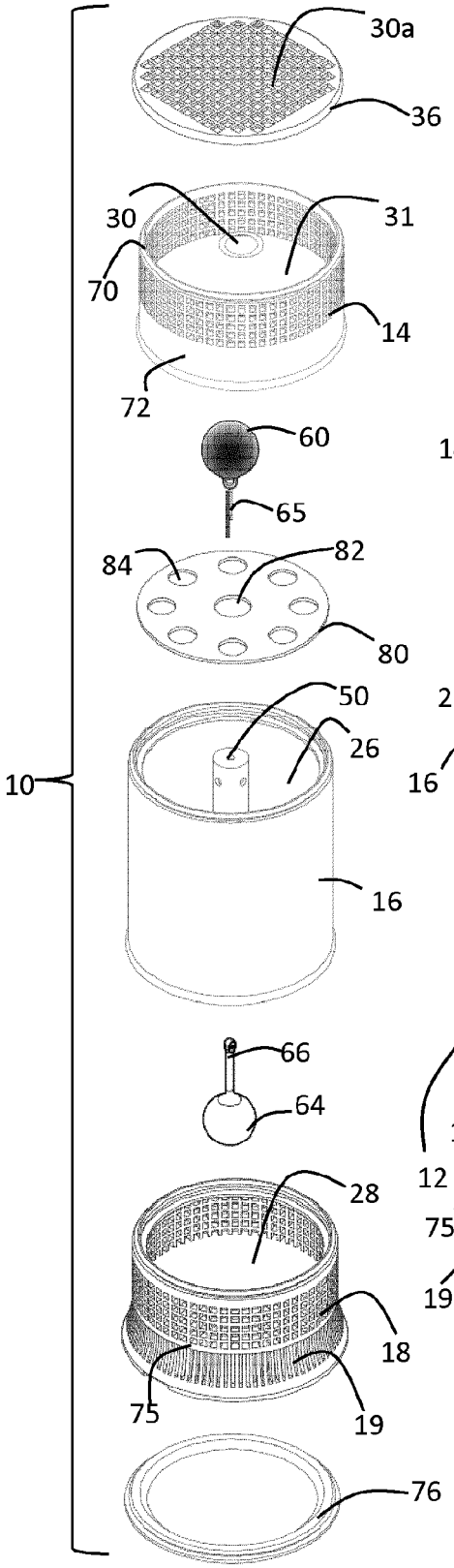
FIG. 1 shows an exploded view of a toilet cleaner device.
Figure 2:
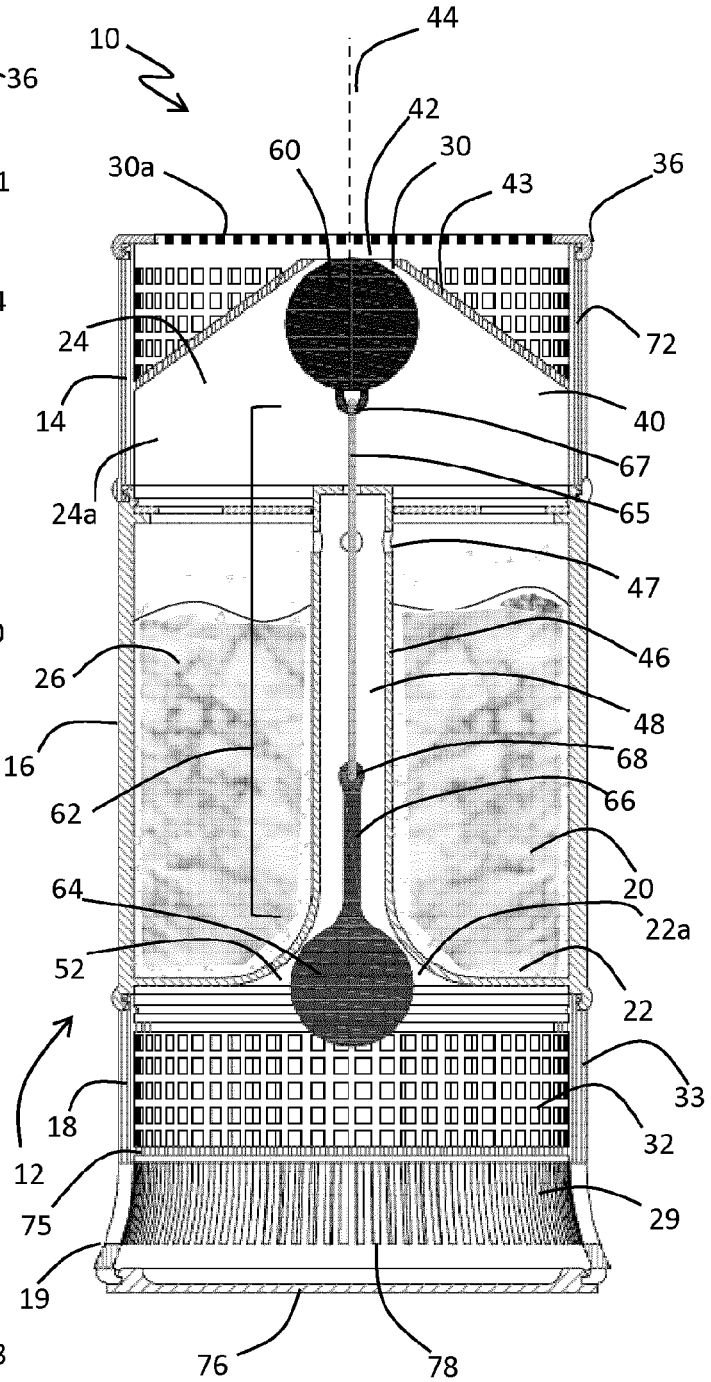
FIG. 2 shows an assembled axial cross-section view of the device shown in FIG. 1.

Now referring to the drawings, an example of a toilet cleaner device 10 is shown in FIG. 1 (exploded view) and FIG. 2 (assembled axial cross-section view). The device 10 is formed in a tubular housing or container 12 comprising a first compartment 14, a second compartment 16, and a third compartment 18 with interior surfaces of the first, second and third compartments (14, 16, 18) respectively defining corresponding interior first, second, and third chambers (24, 26, 28). The term compartment is intended to refer to a structure that partially or fully encloses a cavity or space; the first, second and third compartments will never fully enclose a cavity or space, as operation of the device 10 depends on a water flow drive mechanism during a toilet flush event that requires a sequential flow from the first compartment 14 to the second compartment 16 to the third compartment 18. As such, each of the first, second, and third compartments (14, 16, 18) will have an aperture or opening allowing for flow of water. However, any additional optional compartment that does not require the water flow drive mechanism for functional operation may optionally be fully enclosed and may optionally be sealed to avoid liquid entry. The term chamber is intended to refer to the cavity or space that is partially or fully enclosed by the compartment, and therefore the term chamber may be used interchangeably with the terms cavity or space.

The tubular housing or container 12, and more specifically sequential connection of the first, second and third compartments (14, 16, 18), defines a serial or sequential communication of the interior first chamber 24 (also referred to as a tapered vault), the interior second chamber 26 (also referred to as a cleaner concentrate chamber), and the interior third chamber (also referred to as a cleaner release chamber) 28. More specifically, the tapered vault 24 is communicative with the cleaner concentrate chamber 26, and the cleaner concentrate chamber 26 communicates with the cleaner release chamber 28 through a gap 22*a* in a first barrier 22. The cleaner concentrate chamber 26 is sized to store a cleaner concentrate 20 and a volume of water to provide dissolution of the cleaner concentrate, with an initial amount of cleaner concentrate, prior to installation in a cistern, being sufficient to last for a predetermined threshold number of flush events, for example at least 300 flush events.

The housing or container 12 defines a first inlet 30 and a first outlet 32 for a water flow drive through interior first, second and third chambers (24, 26, 28). More specifically, a first inlet 30 formed in the first compartment 14 provides communicative liquid flow between a first exterior surface 31 of the housing or container 12 and the tapered vault 24, and a first outlet 32 formed in the third compartment 18 provides communicative liquid flow between a second exterior surface 33 of the housing or container 12 and the cleaner release chamber 28. The first inlet 30 may be an aperture formed at the apex of the vault chamber, and optionally may be a combination of the apex aperture and a plurality of openings 30*a* formed in an optional screen mesh cap 36. The first outlet 32 is a plurality of openings formed in a tubular sidewall of the third compartment 18.

The tapered vault 24 is geometrically defined by a base 40, an apex 42 and an axis 44 passing through a center of the base and a center of the apex, the tapered vault formed by one or more tapered sidewalls 43 (shown for exemplification as a single regular cone sidewall) sloping towards the axis 44 of the tapered vault 24 in a direction extending from the base 40 to the apex 42.

A pipe 46 extends from the gap 22*a* in the first barrier 22, the pipe 46 defining a lumen forming a water channel 48 extending between opposing first and second open ends (50, 52) of the pipe, the first open end 50 located proximal to the tapered vault 24 and the second open end 52 located proximal to the cleaner release chamber 28. The pipe 46 forms a liquid seal with barrier 22 at gap 22*a*, for example as occurs by integral manufacture of pipe 46 and barrier 22, such that the cleaner concentrate chamber 26 communicates with the cleaner release chamber 28 through the water channel 48 only. The integral formation of pipe 46 and barrier 22 is equivalent to a single flanged pipe structure; however the barrier 22 and pipe 46 may also be manufactured as separate components. The water channel 48 is co-extensive with pipe 46. The first open end 50, the second open end 52 and the water channel 48 are all substantially co-axially aligned.

An axis of the water channel is often co-axially aligned with the center of the apex 42 of the tapered vault 24. However, deviation from co-axial alignment may be accommodated. For example, the axis of the water channel may be aligned to have less than 30 degrees of an angle of deviation from a co-axial alignment with the center of the apex, the angle of deviation determined as an interior angle between the axis of the water channel and a linear line extending from the center of the apex to the axis of the water channel at the first open end of the pipe. An interior angle is the smaller angle of an intersection of two lines, where the sum of the smaller angle (interior angle) and the larger angle (exterior angle) equals 180 degrees.

Flow of liquid through the water channel 48 is controlled by a buoyant actuator 60 coupled by a tether 62 to a stopper 64, the tether 62 disposed within the water channel 48, the tether 62 having an axial length greater than an axial length of the water channel 48, the buoyant actuator 60 disposed proximal to the first open end 50 of the pipe and the stopper 64 disposed proximal to the second open end 52 of the pipe. The buoyant actuator is selected to have a density lesser than a density of water and when device 10 is filled with water the buoyant actuator provides a buoyant force with a buoyant support vector that opposes a load force exerted by the stopper with a load vector in the direction of the gravity vector. In the presence of water filling the tapered vault 24, the support vector exerted by the buoyant actuator 60 has a greater magnitude than a magnitude of the load vector exerted by the stopper 64, and thus the buoyant actuator maintains a buoyant position and tethers the stopper to a closed position blocking second open end 52 and blocking water flow through the water channel 48 into cleaner release chamber 28. The stopper 64 is constructed with desired material properties and size and shape to block water flow through the water channel 48; and therefore the stopper 64 will typically have a radial cross-sectional area that is greater than an open radial cross-section area of the water channel 48 at a central portion of the pipe. In the absence of water in the tapered vault and optionally in a communicative interface 24*a* between the tapered vault and the cleaner concentrate chamber 26, the support vector exerted by the buoyant actuator 60 has a lesser magnitude than a magnitude of the load vector exerted by the stopper 64, and thus the buoyant actuator drops to a fallen position and the stopper also falls to an open position clearing second open end 52 and releasing water flow through the water channel 48 into cleaner release chamber 28.

The tether 62 can be a single integrated tether or may be composed of multiple components as desired. The tether 62 composed of pivotally coupled first and second portions—a first portion having a first end pivotally coupled to the buoyant actuator 60 and a second end pivotally coupled to a first end of the second portion, a second end of the second portion integrally formed with the stopper—allows for a range of motion of the tether within the water channel 48 to compensate for oblique or tilted placement of the device 10 in a cistern.

FIGS. 1 and 2 show several optional features, one or more of which may be removed, while still maintaining operational efficacy, and various combinations of the optional features can provide for variants of the device 10. For example, the screen mesh cap 36 and the plurality of openings 30*a* formed therein are both optional features that may be removed without a significant impact on operability. The screen mesh cap 36 couples to and fits with a rim 70 of a tubular exterior sidewall 72 of the first compartment 14 to create a partially enclosed space above the first inlet 30, with the first inlet 30 cooperating with the plurality of openings to provide an entry of water flow during a flush event. In presence of the screen mesh cap 36, the first exterior surface 31 continues to be the exterior surface of the one or more tapered sidewalls 43 forming the tapered vault 24. The screen mesh cap 36 provides structural protection of the first inlet 30, but operation of the device 10 can function well without it. The first compartment 14 requires one or more tapered sidewalls 43 forming the tapered vault 24, and optionally includes the tubular exterior sidewall 72. In absence of the screen mesh cap 36, the tubular exterior wall 72 may optionally be maintained with the rim 70 above the first inlet 30, and further optionally with or without openings, as desired to provide structural protection of the first inlet 30. An additional option is to taper the tubular exterior sidewall 72, for example towards the central axis 44 of the tapered vault 24. The first compartment 14 may optionally be formed solely from the one or more tapered sidewalls 43 in absence of both the screen mesh cap 36 and the tubular exterior sidewall 72.

Another optional feature shown in FIGS. 1 and 2, is the plurality of side pipe openings 47 formed in pipe 46, each of the plurality of side pipe openings 47 formed as a bore extending from an exterior surface of the pipe 46 to its interior surface and lumen (water channel 48), each of the plurality of side pipe openings 47 providing fluid communication between the cleaner concentrate chamber 26 and the water channel 48. The plurality of side pipe openings 47 are typically positioned proximal to the first open end 50 and above the initial amount of cleaner concentrate 20 as measured prior to use of the device 10. In presence of the plurality of side pipe openings 47, the first open end 50 of pipe 46 will be sized to be sufficiently large to slidably receive tether 62. In absence of the plurality of side pipe openings 47, the first open end 50 may be enlarged to expand the water channel 48 at the first open end 50, for example so that the first open end 50 provides an open area that is equal to or larger than an open radial cross-section area of the water channel 48 at central portion of the axial length of pipe 46.

Another optional feature shown in FIGS. 1 and 2, is a divider screen 80 positioned proximal to the first open end 50, the divider screen 80 defining a first divider aperture 82 for interference fit with pipe 46 proximal to first open end 50 and a plurality of second divider apertures 84. The plurality of second divider apertures 84 are each laterally or radially spaced from the first divider aperture 82, and are each laterally or radially spaced from an axis of the water channel 48, and provide fluid communication between the tapered vault 24 and cleaner concentrate chamber 26. The plurality of second divider apertures 84 function to focus water flow to generate a jet stream effect as water current flows sequentially from the tapered vault 24 to the cleaner concentrate chamber 26 during a flush event. As a further option, the divider screen 80 may be decoupled from pipe 46 and connected to the interior surface of the first compartment 14 above the first open end 50 with the first divider aperture 82 providing a support for a fallen position of buoyant actuator 60. A jet stream effect produced by the divider screen 80 provides for improved dissolution of a solid or semi-solid cleaner concentrate, but will likely be unnecessary for dissolution of a fluid or semi-fluid cleaner concentrate.

Another optional feature shown in FIGS. 1 and 2, is one or more hinged joints of tether 62. Tether 62 may be made of a flexible material or a rigid material or a combination of both relatively flexible portions and relatively rigid portions. Furthermore, tether 62 may have elastic portions. Hinged joints for coupling tether 62 to buoyant actuator 60 or stopper 64 or for coupling two adjacent portions of tether 62 may be useful, particularly where tether 62 or a portion thereof is characterized by a relatively hard and/or rigid material property. The tether 62 comprises two portions (also referred to as linkages), a first portion 65 pivotally coupled by first hinge joint 67 to buoyant actuator 60, and a second portion 66 pivotally coupled by second hinge joint 68 to the first portion 65. The second portion 66 is shown as being integrally formed with stopper 64, but optionally could be pivotally coupled by a third hinge joint to stopper 64. The first hinge joint 67 supports rotation of the buoyant actuator 60 relative to the first portion 65, and the second hinge joint 68 supports rotation of the first portion 65 relative to the second portion 66. Incorporation of hinged joints allows the tether 62 to be made of relatively hard and/or rigid material to withstand stress and wear of the desired number of flush events, while possessing freedom of range of angular motion to compensate for lateral movement of buoyant actuator 60 and/or stopper 64 or to compensate for an uneven or unlevelled positioning of the device 10, such as may occur on an uneven cistern floor.

Another optional feature shown in FIGS. 1 and 2, is a fourth compartment 19 positioned at a base of the container 12, proximal to the first outlet 32 and distal from first inlet 30. The fourth compartment 19 is positioned below the third compartment 18, and is separated from the third compartment 18 by a solid continuous barrier 75. The fourth compartment 19 defines an interior fourth chamber 29 (also referred to as a base ballast chamber) which stores a weighted material (a material significantly more dense than water such as a stone, glass, metal, and the like) providing a weighted base in container 12 for greater stability to withstand a flush event water flow surrounding container 12 when free standing on a cistern floor. A base cap 76 cooperates with one or more sidewalls of the fourth compartment 19 to provide a base closure of the fourth compartment 19. The base cap 76 may optionally be configured with a water seal. One or more sidewalls of the fourth compartment 19 may optionally define a plurality of base openings 78. The plurality of base openings 78 may be removed without significant impact on operation of the device 10. Optionally, the fourth compartment 19 may be configured to be fully enclosed with no liquid communication between an exterior surface of container 12 and the interior fourth chamber 29. The fourth compartment may be sized as desired and with an axial length as desired to position the first inlet 30 and the first outlet 50 between a resting high water level of the cistern and an active low water level transiently occurring during a flush event.

Figure 3A:
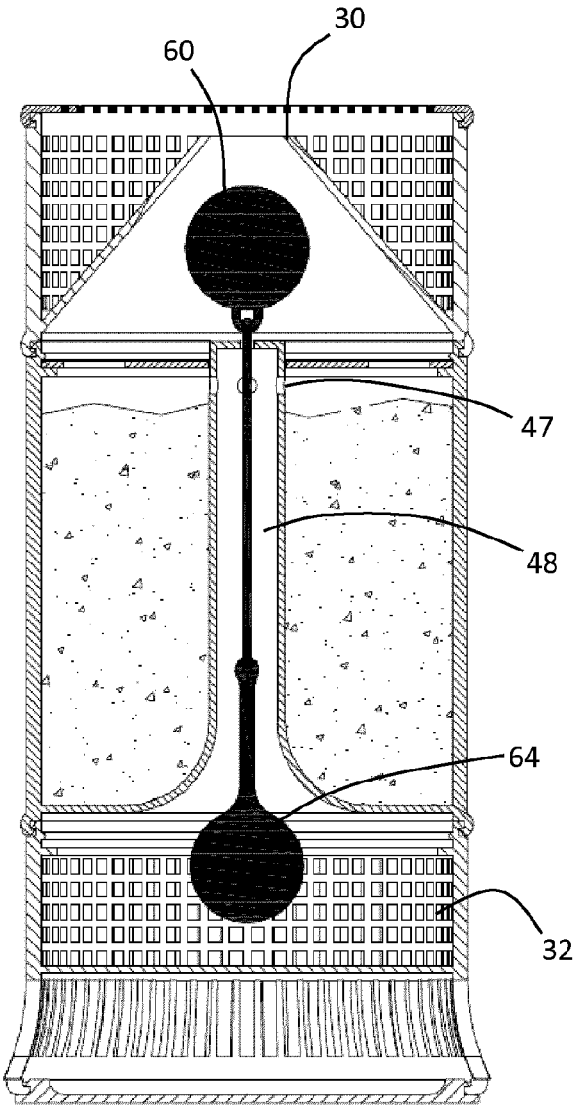
FIG. 3A and FIG. 3B show a comparison of an opened and closed configuration of a water channel in the device shown in FIG. 1.
Figure 3B:
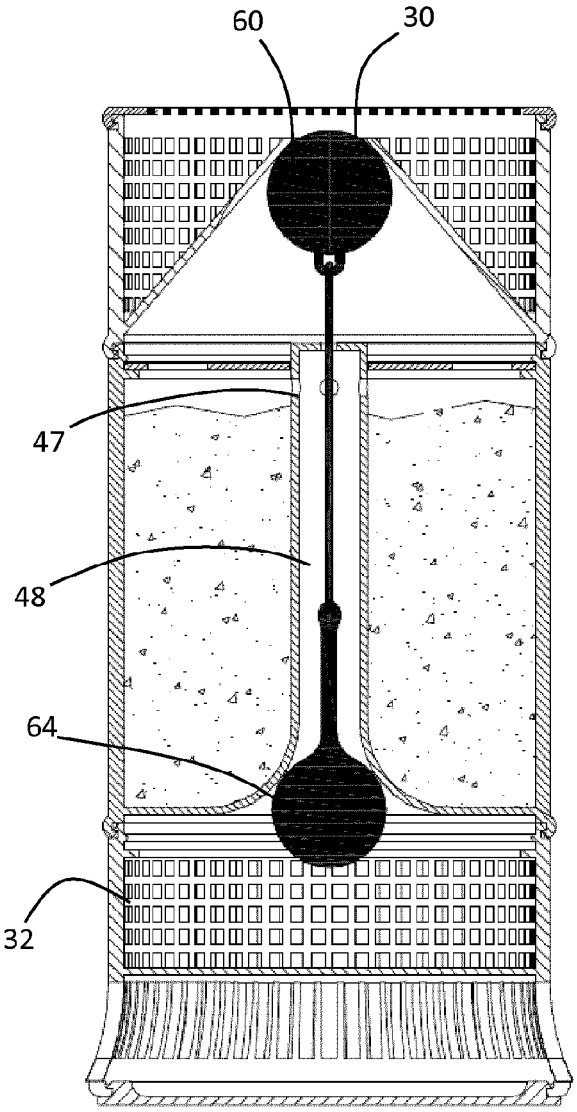

FIGS. 3A and 3B show an illustration of operation of the device 10 shown in FIGS. 1 and 2. In operation, during a flush event water in the cistern drops from a high water level to a low water level (for toilets with multiple flush options the low water level may be one of a plurality of low water level options depending on a selected flush option) and this sudden change in cistern water levels provides a water flow drive through container 12. Increased water flow pressure and turbulence is exerted upon first inlet 30 and shortly thereafter (within a typical interval of less than a second) water drainage begins through the first outlet 32 further enhancing water flow through container 12 and causing the buoyant actuator 60 to move from a resting buoyant position to a fallen position with corresponding movement of the tethered stopper 64 from a closed position to an open position. Turbulence from the sudden change in cistern water levels provides a water flow that impacts a water volume above the cleaner concentrate and depending on strength of pressure and turbulence may impact the exposed surface of cleaner concentrate held in the cleaner concentrate chamber; and if the divider screen is present then its jet stream effect enhances disruption of the surface integrity of the cleaner concentrate. Once the stopper 64 begins to move from a closed position to an open position, the cleaning solution resulting from cleaner concentrate dissolution in the water channel 48 begins to drain freely due to gravity along with drainage of cleaning solution from the tapered vault and cleaner concentrate chambers until the water in these chambers falls below the plurality of side pipe openings 47.

Typically, a low water level occurs transiently during a flush event with cistern water levels beginning to rise immediately after the low water level occurs. Also typically, a rise phase of cistern water levels although still turbulent is significantly slower than the rapid fall of cistern water levels during a drop phase. As cistern water levels rise, water flow enters through the first outlet 32 displacing air from the cleaner release chamber through the water channel 48 into the tapered vault. With a further rise in cistern water level, water flows from water channel 48 through the plurality of side pipe openings 47 and first open end 50 to fill the cleaner concentrate chamber and tapered vault with water that displaces air out of the first inlet 30. Water entering into the cleaner concentrate chamber immediately begins dissolving the cleaner concentrate, the dissolution process aided by the surface disruption of the cleaner concentrate that occurred during the drop phase of cistern water levels. As water levels rise in the tapered vault the buoyant actuator 60 returns to its resting buoyant position impeding water flow through the first inlet 30. In the rest phase between flush events dissolution of cleaner concentrate occurs so that the cleaner concentrate chamber and the water channel 48 contains a volume of cleaning solution. However, the cleaning solution remains within the container 12 (and more specifically within the cleaner concentrate chamber, the water channel and the tapered vault) due to blockage of the water channel 48 by the stopper 64 and blockage of the first inlet 30 by the buoyant actuator 60. The rest phase between flush events is characterized by a resting minimized water current and therefore the blockage of the first inlet 30 can occur without an abutment of the buoyant actuator with the apex of the tapered vault, and a resting buoyant position in between the apex and the base of the tapered vault can also prevent leakage of cleaning solution through the first inlet 30. Furthermore, a tight engagement of the buoyant actuator with first inlet 30 is avoided so as to allow for escape of air. Thus, a resting buoyant position of the buoyant actuator proximal to the first inlet 30 is sufficient to prevent leakage of cleaning solution while permitting venting of air.

An illustrative version and several variants of an automatic toilet cleaner device have been described above without any intended loss of generality. Further examples of modifications and variation are now provided. Still further variants, modifications and combinations thereof are contemplated and will be apparent to the person of skill in the art.

Figure 4:
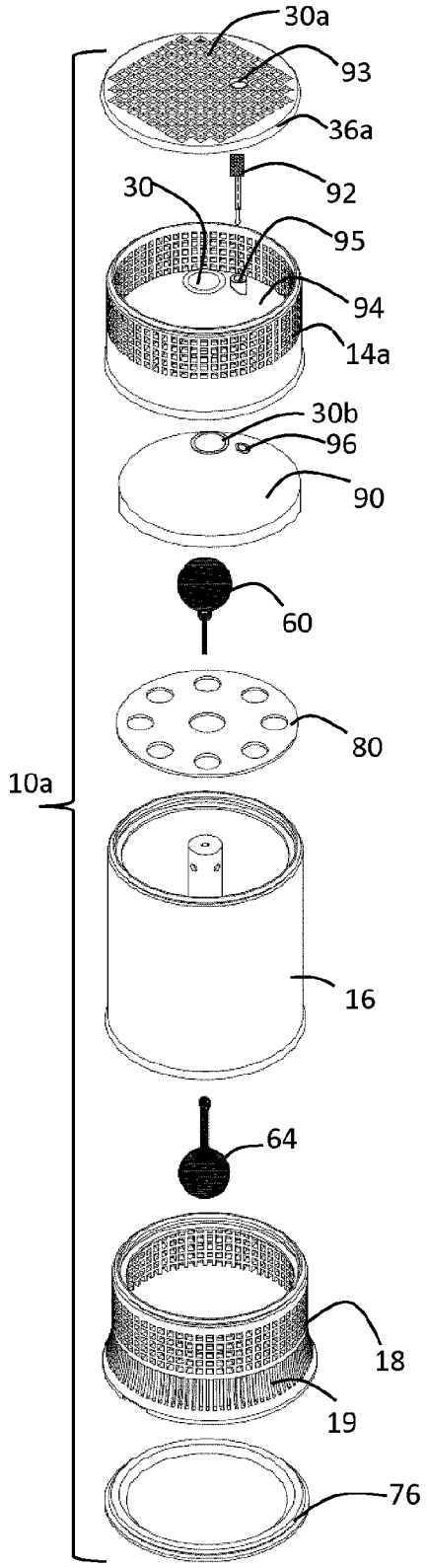
FIG. 4 shows an exploded view of a first variant of the device shown in FIG. 1.
Figure 5:
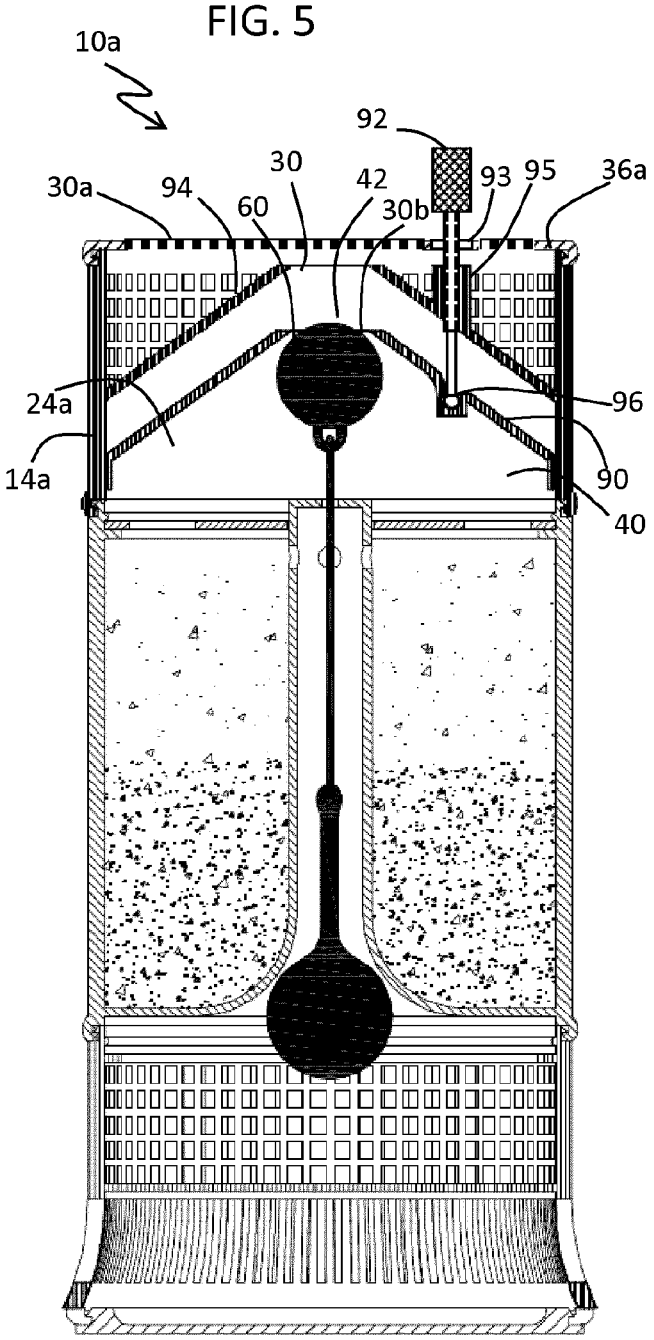
FIG. 5 shows an assembled axial cross-section view of the first variant device shown in FIG. 4.

For example, FIGS. 4 and 5 show a variant toilet cleaner device 10*a* that differs from device 10 by including an adjustable tapered cap 90 to define an adjustable tapered vault 24*a*. The variant device 10*a* comprises a fixed tapered sidewall 94 formed inside a variant first compartment 14*a*. The fixed tapered sidewall 94 defines the first inlet 30 for passage of water flow, and incorporates an internally threaded sleeve nut 95. The adjustable tapered cap 90 defines an adjunct first inlet 30*b* for passage of water flow, and incorporates a bolt bushing 96, the bolt bushing 96 having a single flanged opening. A variant screen mesh cap 36*a* defines a plurality of openings 30*a* for passage of water flow, and incorporates a bolt aperture 93. A threaded bolt 92 with a ball tip, threadably engages sleeve nut 95, with the ball tip snap fit within bolt bushing 96 and retained by the flange to provide a free rotation joint of the threaded bolt 92 with the adjustable tapered cap 90. A shaft body of the threaded bolt 92 also freely rotates within bolt aperture 93 to provide a free rotation joint of the threaded bolt 92 with the variant screen mesh cap 36*a*. The bolt bushing 96, the threaded sleeve nut 95, and the bolt aperture 93 are coaxially aligned so as to receive different portions of the threaded bolt 92 simultaneously. Rotation of the threaded bolt 92 within mating threads of the threaded sleeve nut 95 provides for translation of the threaded bolt 92 relative to the fixed tapered sidewall 94 resulting in linear motion of the adjustable tapered cap 90 towards or away from the fixed tapered sidewall 94 depending on the direction of rotation (clockwise versus counter-clockwise) and consequent adjustment of the volume of the adjustable tapered vault 24*a*. The plurality of openings 30*a*, the first inlet 30 and the adjunct first inlet 30*b* all cooperate to function as a first inlet for water flow during a flush event. The adjustability of tapered vault 24*a* may be achieved through any other convenient mechanism for adjusting the spacing of tapered sidewalls and it apex relative to the first open end of the pipe 46 and water channel 48 formed therein. For example, without requiring an additional tapered cap, the device 10 may be modified to cut a slot extending in an axial direction in the exterior sidewall 72 of first compartment 14, the length of the slot defining a range of adjustment. A bolt received through the slot engages a threaded nut sleeve incorporated in a circumferential region of the tapered sidewall 43 with the bolt tightened to the threaded nut sleeve to maintain a first fixed position of the tapered sidewall 43 and the bolt loosened from the threaded nut sleeve to provide adjustment of the tapered sidewall to a second fixed position in the slot. Additionally, the slot may configured with détente features to assist in transitioning from a first fixed position to a second fixed position. Additionally, the slot/bolt/nut sleeve combination may be duplicated so that the combination is disposed on opposing sides of the exterior sidewall 72 of first compartment 14 to enhance circumferential abutment of the tapered sidewall 43 to the interior surface of the exterior sidewall 72.

Figure 6:
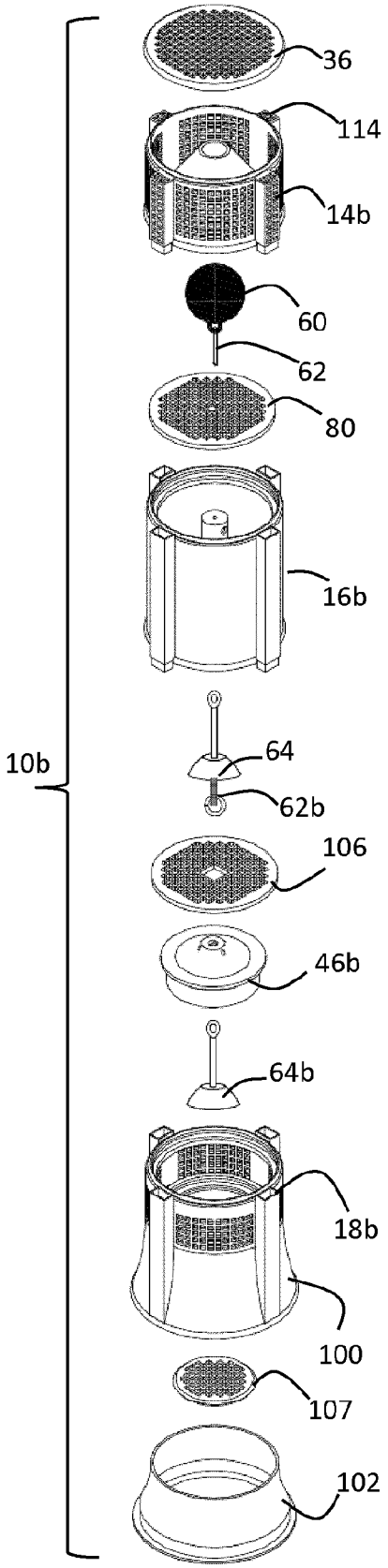
FIG. 6 shows an exploded view of a second variant of the device shown in FIG. 1.
Figure 7:
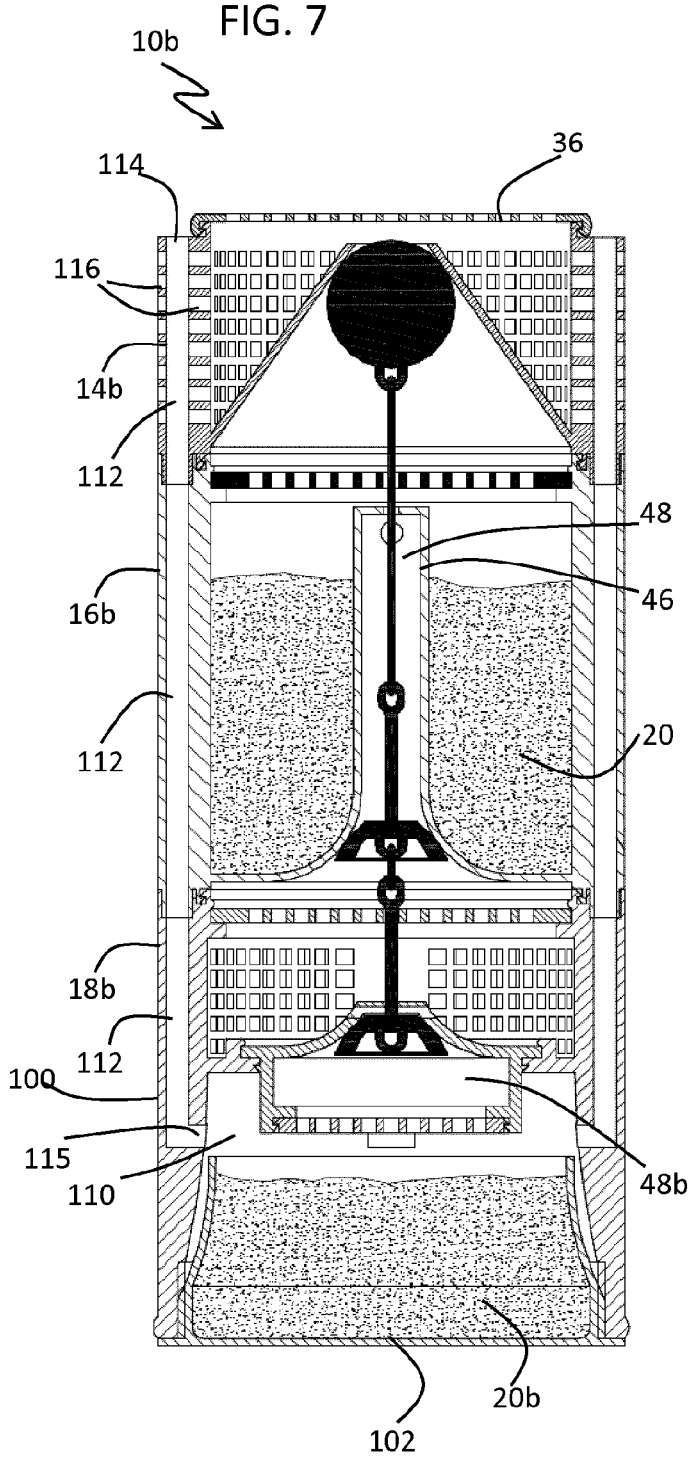
FIG. 7 shows an assembled axial cross-section view of the second variant device shown in FIG. 6.

FIGS. 6 and 7 show a variant toilet cleaner device 10*b* that differs from device 10 by including a fifth compartment 100 defining a fifth chamber 110 (also referred to as an auxiliary cleaner concentrate chamber) and associated additional components for regulating release of dissolved cleaner concentrate from the fifth chamber 110. Reference to a fifth chamber 110 does not imply a need for fourth chamber 29 (ballast chamber), and inclusion of the fourth chamber 29 is not shown in FIGS. 6 and 7, but may be optionally included. The fifth compartment 100 comprises a tubular sidewall defining a tubular interior fifth chamber 110. A base of the fifth compartment defines an open space with an open radial cross-section area sized to receive a bucket 102, the bucket 102 storing an auxiliary amount of cleaner concentrate 20*b*. The fifth compartment further defines a portion of a plurality of auxiliary water inlets 112 formed circumferentially and extending in an axial direction and communicating with a water volume of the fifth chamber 110 located above the auxiliary amount of cleaner concentrate 20*b*. The fifth compartment further includes an auxiliary pipe 46*b* having auxiliary open opposing ends and defining an auxiliary water channel 48*b* extending between the auxiliary open opposing open ends providing fluid communication from the fifth chamber 110 and its dissolved auxiliary cleaner concentrate. Flow through the auxiliary water channel is regulated by auxiliary stopper 64*b* that is coupled by auxiliary tether 62*b* to stopper 64. The variant device 10*b* is formed by serial connection of variant first compartment 14*b*, variant second compartment 16*b*, variant third compartment 18*b* and the fifth compartment 100. Variant first and second compartments (14*b*, 16*b*) are similar to first and second compartments (14, 16) with a significant difference being a portion of the plurality of auxiliary water inlets 112 formed circumferentially and extending in an axial direction. Variant third compartment 18*b* is similar to third compartment 18 with significant differences being a portion of the plurality of auxiliary water inlets 112 formed circumferentially and extending in an axial direction, and fluid communication with both pipe 46 and associated water channel 48 formed in the variant second compartment 16*b* and auxiliary pipe 46*b* and its associated auxiliary water channel 48*b* formed in the fifth compartment 100. The portions of the plurality of auxiliary water inlets 112 formed in the variant first, second, and third compartments (14*b*, 16*b* and 18*b*) and the fifth compartment 100 are co-aligned and mated to provide a plurality of auxiliary water inlets 112, with each auxiliary water inlet 112 providing a continuous or unimpeded water flow communication from a first open end 114 of the auxiliary water inlet located proximal to a rim of variant first compartment 14*b* and then along a circumferential region of each of variant first, second and third compartments and then to an opposing second open end 115 of the auxiliary water inlet communicating with the water volume of the fifth chamber 110. Optionally, the first open end of 114 may cooperate with one or more side openings 116 to provide water flow into the plurality of auxiliary water inlets 112. Also, optionally the first open end 114 may be covered by a screen mesh to provide a plurality of openings that cooperate to form the first open end 114. The plurality of auxiliary water inlets 112 are isolated from direct communication or entry with any of the interior chambers of the variant first, second and third compartments. While the plurality of auxiliary water inlets 112 are shown in an extended version, the axial length of each of the plurality of auxiliary water inlets 112 may each be readily and independently minimized, including for example being formed in the variant third compartment 18*b* and the fifth compartment 100 only. Regardless of size and shape, the function of each auxiliary water inlet 112 is to provide communicative flow between the fifth chamber and a third exterior surface of the container 12, as compared to the first inlet 30 that is communicative between a first exterior surface and the first chamber, or as compared to the first outlet 32 that is communicative between a second exterior surface and the third chamber. Screen mesh discs 106 and 107 are also optional features that may be incorporated to prevent undissolved cleaner concentrate granules from entering the third chamber (cleaner release chamber) and the auxiliary water channel 48*b*, respectively. Screen mesh discs (106, 107) may also improve mixing and homogeneity of dissolved cleaning solution. The cleaner concentrate 20 and auxiliary cleaner concentrate 20*a* may be the same or different as suited to a specific implementation. The second and fifth compartments have generally similar functions in that both store a cleaning agent and provide for dissolution of the cleaning agent with water inflow from the cistern, and therefore some components housed or formed within these two compartments may be referenced by generally similar terms and the term auxiliary is used to distinguish corresponding generally similar terms. However, for convenience of reference, the word auxiliary may be replaced with the word second for referencing components of the fifth compartment and the corresponding generally similar term for the second compartment may be preceded by the term first.

Figure 8A:
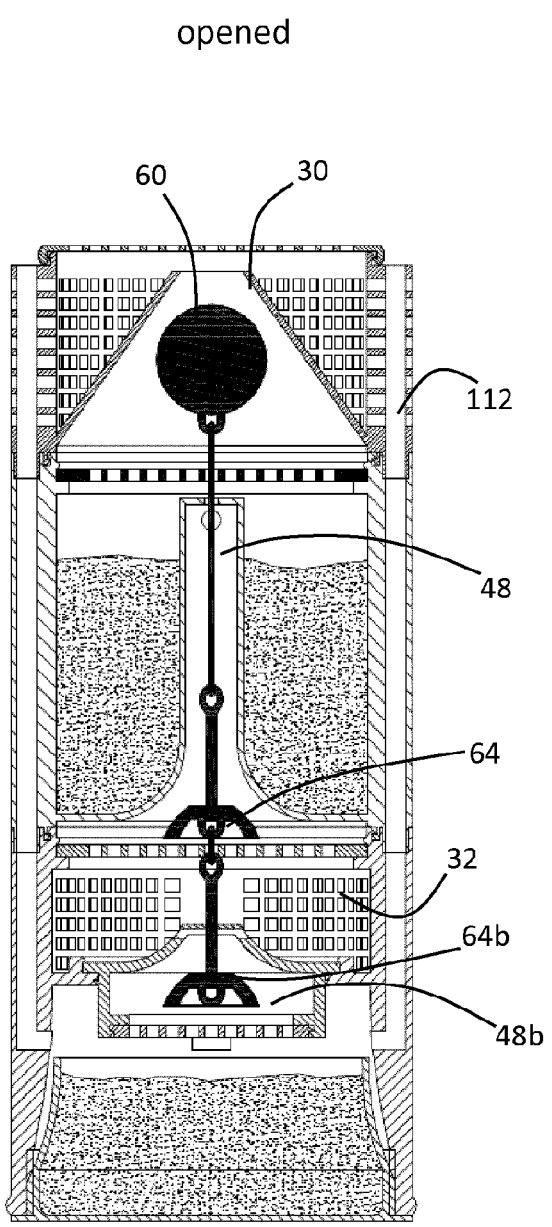
FIG. 8A and FIG. 8B show a comparison of an opened and closed configuration of a water channel and an auxiliary water channel in the device shown in FIG. 6.
Figure 8B:
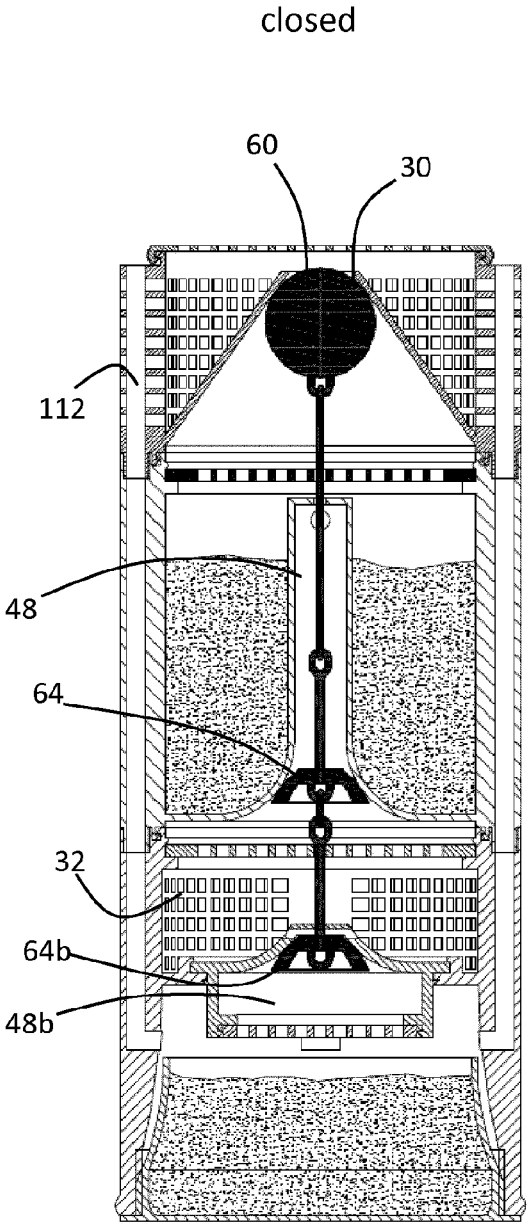

FIGS. 8A and 8B show an illustration of operation of the variant device 10*b* shown in FIGS. 6 and 7. In operation, similar to device 10, during a drop phase of a flush event increased water flow pressure and turbulence is exerted upon first inlet 30 and shortly thereafter (within a typical interval of less than a second) water drainage begins through the first outlet 32 further enhancing water flow through container 12 and causing the buoyant actuator 60 to move from a resting buoyant position to a fallen position with coordinated movement of both the tethered stoppers 64 and 64*b* from a closed position to an open position. Once the stopper 64 begins to move from a closed position to an open position, the cleaning solution resulting from cleaner concentrate dissolution in the water channel 48 begins to drain freely due to gravity along with drainage of cleaning solution from the tapered vault and cleaner concentrate chambers. Simultaneous with water flow through the first inlet 30, water pressure and turbulence impacts water in the plurality of auxiliary water inlets 112 pushing water into the fifth chamber and displacing dissolved cleaning concentrate through auxiliary water channel 48*b* upon drop of tethered stopper 64*b* to an open position.

During a subsequent rise phase of a flush event, water flow enters through the first outlet 32 filling the cleaner release chamber and falling into fifth chamber displacing air from the cleaner release chamber through the water channel 48 into the tapered vault and displacing air from the fifth chamber (auxiliary cleaner concentrate chamber) and through auxiliary water inlets 112. With a further rise in cistern water level, water flows from water channel 48 to fill the cleaner concentrate chamber and tapered vault with water that displaces air out of the first inlet 30. As water levels rise in the tapered vault the buoyant actuator 60 returns to its resting buoyant position impeding water flow through the first inlet 30, and returning tethered stoppers 64 and 64*b* to their respective closed position.

Figure 9:
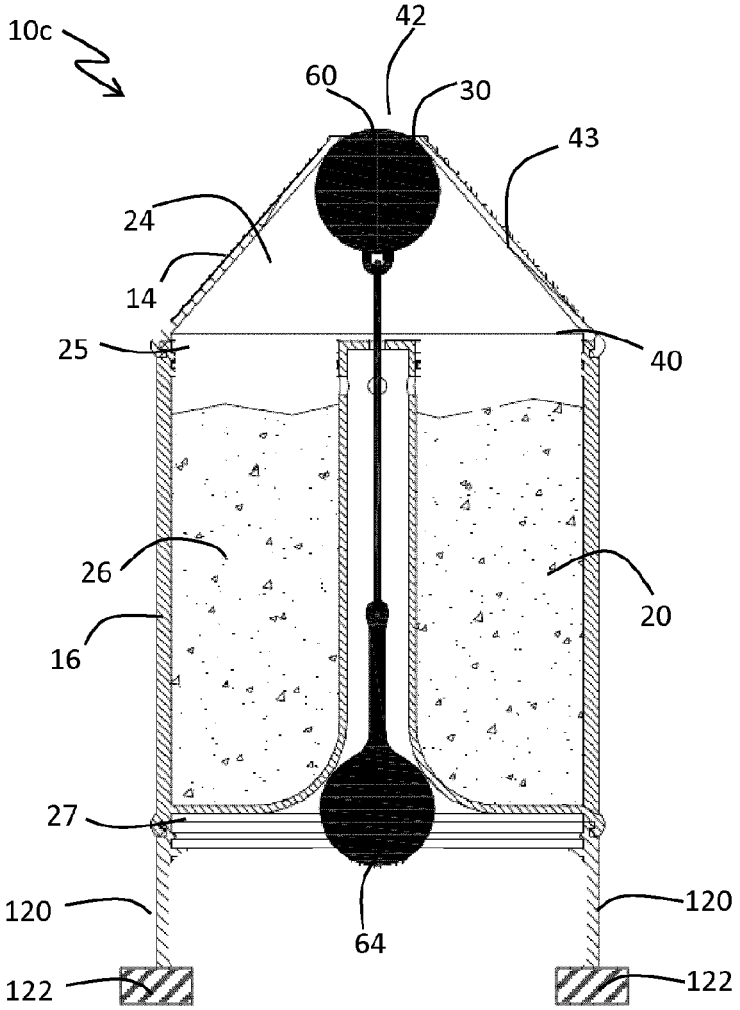
FIG. 9 shows an assembled axial cross-section view of a third variant of the device shown in FIG. 1.

First, second, third, fourth and fifth chambers have been described above. However, only the first chamber (tapered vault) and the second chamber (cleaner concentrate chamber) are required to produce a functional toilet cleaner device. For example, an operable toilet cleaner device comprises: a container 12 defining a first chamber 24 and a second chamber 26, the first chamber 24 communicative with the second chamber 26, the second chamber storing a cleaner concentrate 20; the first chamber 24 formed as a tapered vault defined by a base 40, an apex 42 and an axis 44 passing through a center of the base and a center of the apex, the tapered vault formed by one or more tapered sidewalls 43 sloping towards the axis of the tapered vault in a direction extending from the base 40 to the apex 42; a first inlet 30 communicative with the first chamber 24, the first inlet 30 formed at or proximal to the apex 42; the second chamber 26 having a first end 25 communicative with the first chamber 24 and a second end 27 enclosed by a first barrier 22 defining a gap 22*a*; a pipe 46 extending from and sealing the gap 22*a* in the first barrier 22, the pipe 46 forming a water channel 48 extending between opposing first 50 and second 52 open ends of the pipe, the first open end 50 located at or proximal to the first end 25 of the second chamber 26 and the second open end 52 located at or proximal to the second end 27 of the second chamber 26; a buoyant actuator 60 coupled by a tether 62 to a stopper 64, the tether 62 disposed within the water channel 48, the buoyant actuator 60 disposed proximal to the first open end 50 of the pipe 46 and the stopper 64 disposed proximal to the second open end 52 of the pipe 46. FIG. 9 shows an illustrative example of a minimal variant toilet cleaner device 10*c* which includes the first chamber 24 and second chamber 26 but does not require any of third, fourth and fifth chambers. Minimal variant device 10*c* differs from device 10 in that: first compartment 14 maintains only the tapered sidewalls forming the tapered vault 24 and the first inlet 30, and removes the tubular exterior sidewall 72, its rim 70 and its closure by screen mesh cap 36; and replacement of third and fourth compartments with support legs 120 that terminate with weighted feet 122 shaped for abutting support on a cistern floor and providing ballasting of the device. The weighted feet 122 need not be separate discontinuous weighted members, and may be shaped as a continuous disc or a continuous ring, as desired. The second compartment and water flow regulation by buoyant actuator and tethered stopper of the minimal variant device 10*c* remains substantially similar to the corresponding second compartment and buoyant actuator and tethered stopper shown for device 10. The minimal variant device 10*c* can be further modified to remove legs 120 and weighted feet 122 if the second compartment 16 is attached to a hanger, with the hanger configured to hang device 10*c* at a suitable depth relative to expected high water and low water levels in the cistern.

One or more of the third, fourth and fifth chambers may be combined with the minimally required first and second chambers to suit a specific implementation. For example the fourth compartment defining the fourth chamber may be connected to legs 120, replacing the weighted feet 122, so that the water channel is communicative between the second chamber and a portion of the container in between the second chamber and the fourth chamber. As another example, the fifth compartment defining the fifth chamber may be connected to legs 120, replacing the weighted feet 122, so that: the water channel is communicative between the second chamber and a portion of the container in between the second chamber and the fifth chamber; and the auxiliary water channel is communicative between the fifth chamber and a portion of the container in between the fifth chamber and the second chamber. The preceding two examples make evident that the portion of the container in between the second chamber and either the fourth chamber or the fifth chamber may be varying extents of openness, for example being substantially open if legs 120 are a pair of opposing legs, and being less open if legs 120 are 4 legs (two pairs of opposing legs), and being even less open if the portion in between is the third compartment with a defined first outlet.

Advantages of the toilet cleaner device have been described above, and further advantages may be discerned by comparing the minimal variant 10*c* with its illustrative combinations with one or more of the third, fourth and fifth chambers. Minimal variant 10*c* protects and aligns buoyant actuator 60 which is a significant advantage compared to a removal of first compartment 14 and the tapered vault 24 formed therein. Exposure of buoyant actuator 60 to the sudden turbulence of a drop phase of a flush event can create stress and wear on not only the buoyant actuator, but also the tether, and the water channel. The stress and wear may not be evident over the course of tens of flushes, but considering the device is intended for hundreds of flushes and perhaps even greater than a thousand flushes, the wear and stress could occur with undesired frequency over the life span of the device. Therefore, the tapered vault (first chamber) is a minimal requirement along with the cleaner concentrate chamber (second chamber). A further advantage of the tapered vault is that it prevents the buoyant actuator from possible interference with toilet parts, surrounding structure and flushing system housed within the cistern. In considering the advantages conferred by the tapered vault, it is evident that similar advantages of protection from wear and stress and prevention from interference with toilet parts may be conferred by inclusion of third compartment and the third chamber formed therein in respect of the stopper 64 and its motion relative to water channel 48. The advantage of the fourth chamber (ballast chamber) is greater stability and the fourth chamber could be used in combination with the minimal variant device 10*c* replacing weighted feet 122 or could be used in combination with one or both of third and fifth chambers. The advantage of the fifth chamber is to add further flexibility to the device by adding a release of an auxiliary cleaner concentrate which can be differently configured than the cleaner concentrate 20 in the second chamber so as to provide a modified cleaner release profile. While the second chamber is shown to contain a larger volume than the fifth chamber, the relative volumes of these chambers may be adjusted as desired to suit a specific implementation.

Further advantages may be common to all combinations of the first, second, third, fourth and fifth chambers. For example, an orientation of the buoyant actuator positioned above the water channel and the stopper positioned lower than the buoyant actuator provides a significant advantage as compared to a reverse orientation of the stopper positioned above the buoyant actuator, which advantage becomes evident when observing a rise phase of a flush event where the actuator/stopper orientation shown in the drawings allows for sequential filling of water and efficient displacement of air as compared to a reverse orientation where the buoyant actuator would block water channel 48 as soon as cistern water levels rise to the bottom of the second chamber preventing filling of the second chamber by water flow through water channel 48 and resulting in filling through first inlet which would then be obstructed by stopper in a raised position significantly increasing chances of trapped air and compromising dissolution of cleaner concentrate. Trapped air is to be avoided, and therefore a tight engagement of the buoyant actuator with first inlet 30 is avoided so as to allow for escape of air; a resting buoyant position of the buoyant actuator proximal to the first inlet 30 is sufficient to prevent leakage of cleaning solution while permitting venting of air. As another example of an advantage that may be conferred in all contemplated combination, is configuring the first compartment 14 to position the first inlet at the apex of the tapered vault as compared to having a sealed apex and positioning the first inlet offset from the apex. An offset first inlet will require that an additional air outlet be disposed at the apex or risk air being trapped within the tapered vault, which may alter water flow and motion of the buoyant actuator and stopper, and may also risk altering dissolution of the cleaner concentrate. An offset first inlet typically will require a greater height for tapered vault compared to the first inlet positioned at the apex to allow for efficient motion of buoyant actuator in transitioning from a buoyant position to a fallen position. Regardless of the height of the tapered vault an offset first inlet increases risk of water pressure and turbulence buffeting the buoyant actuator offline from the water channel increasing risks of wear and stress on the buoyant actuator, the tether and the water channel. An offset first inlet can produces uneven water flow, while a first inlet at the apex is more likely to create a repeatable even water flow into the tapered vault and second chamber providing for an even impact or dispersion of the cleaner concentrate surface.

Figure 10A:
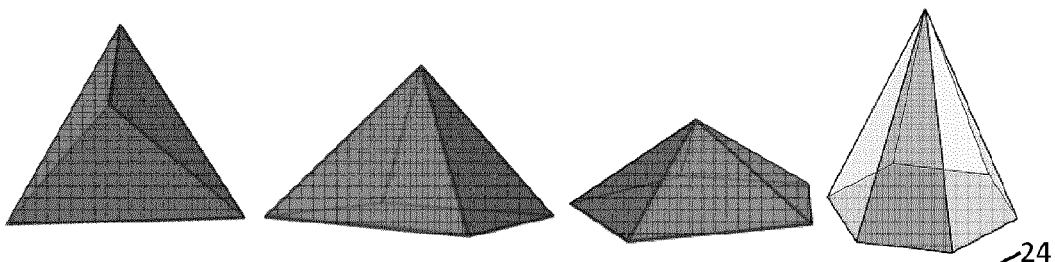
FIG. 10A shows examples of a pyramidal shape for a tapered vault of the devices shown in FIGS. 1-9.
Figure 10B:
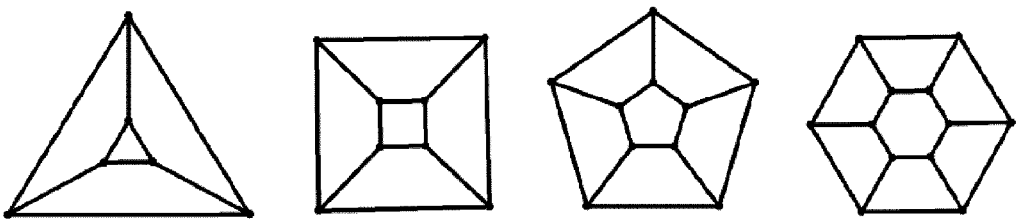
FIG. 10B shows examples of a frusto-pyrimidal shape for a tapered vault of the devices shown in FIGS. 1-9.
Figure 11:
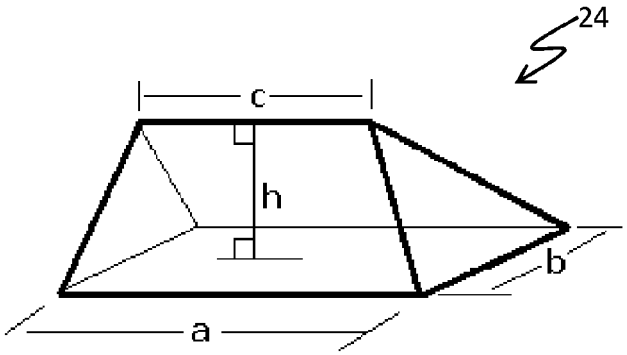
FIG. 11 shows examples of a wedge shape for a tapered vault of the devices shown in FIGS. 1-9.
Figure 11:
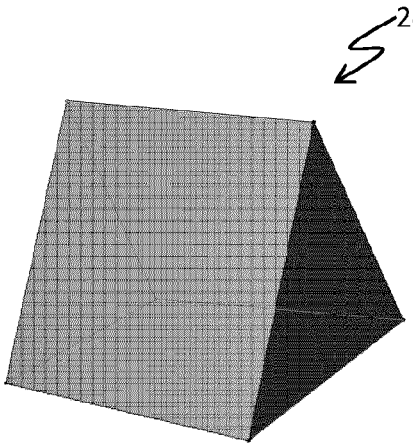
Figure 11:
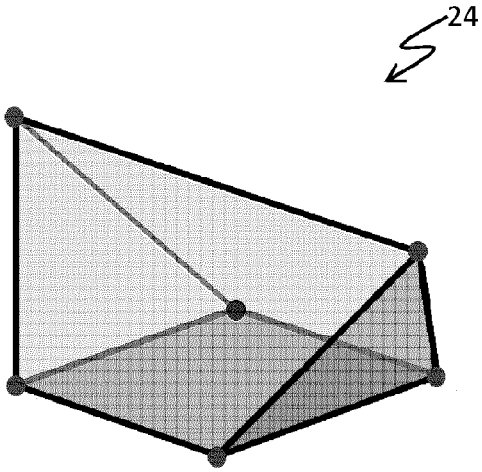
Figure 12:
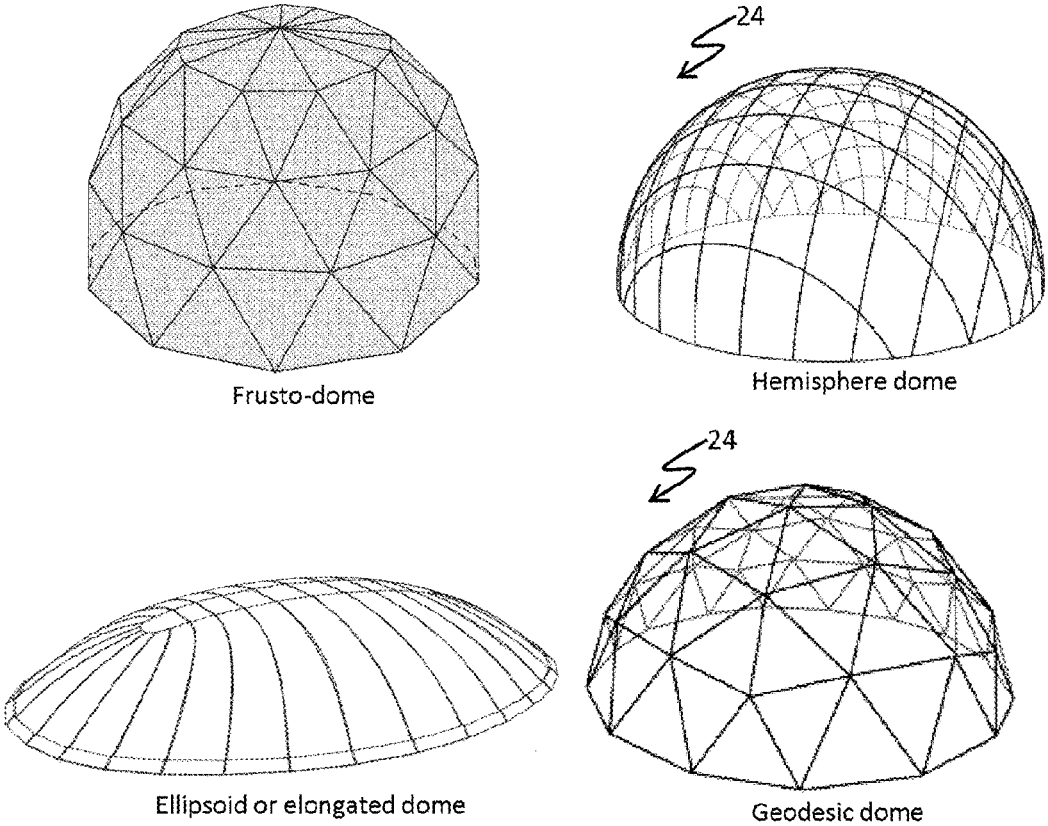
FIG. 12 shows examples of a dome shape for a tapered vault of the devices shown in FIGS. 1-9.
Figure 13:
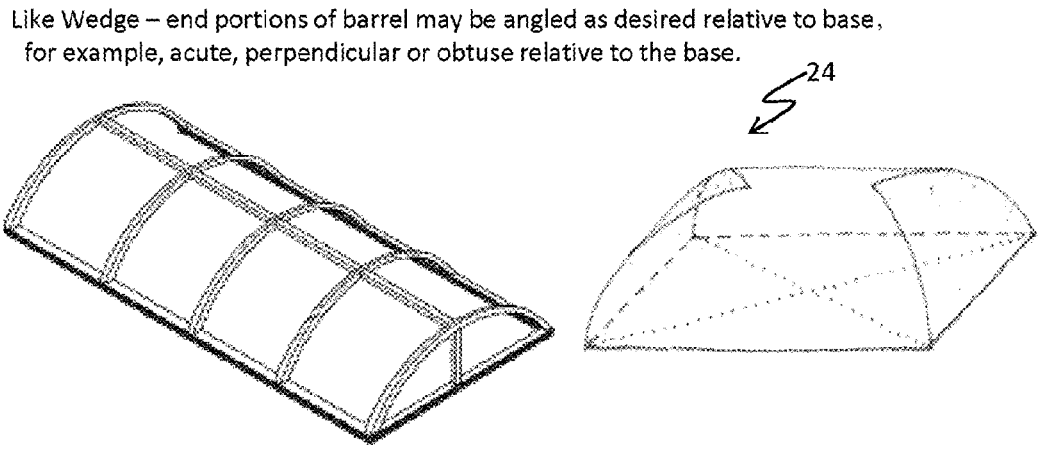
FIG. 13 shows examples of a barrel shape for a tapered vault of the devices shown in FIGS. 1-9.
Figure 14:
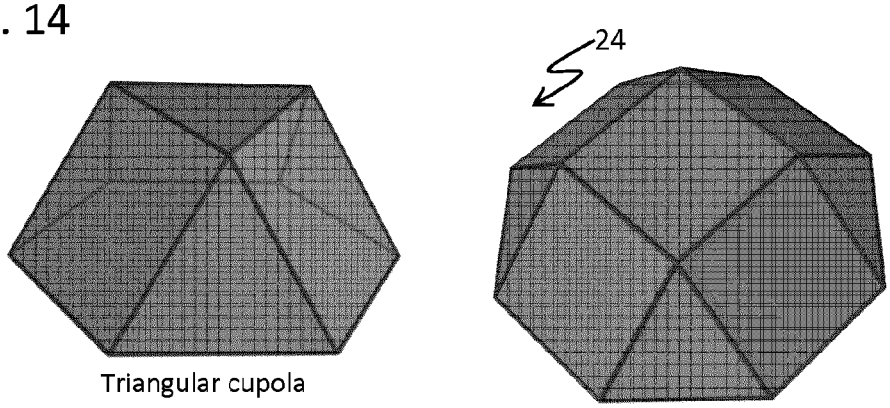
FIG. 14 shows examples of a cupola shape for a tapered vault of the devices shown in FIGS. 1-9.
Figure 15:
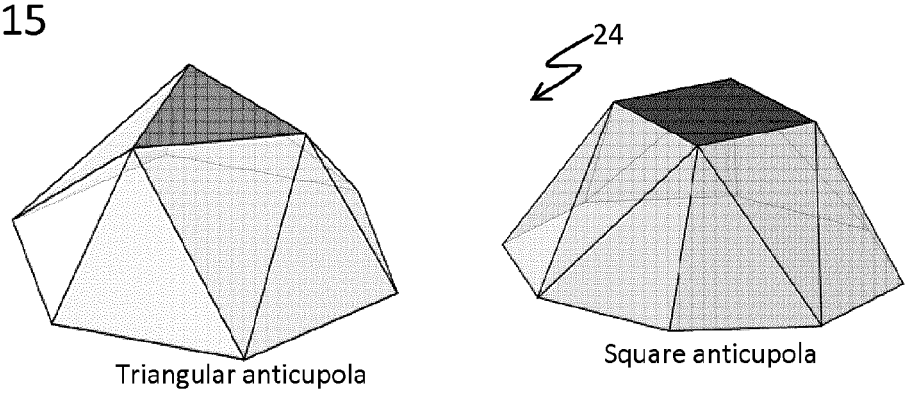
FIG. 15 shows examples of an anticupola shape for a tapered vault of the devices shown in FIGS. 1-9.
Figure 16:
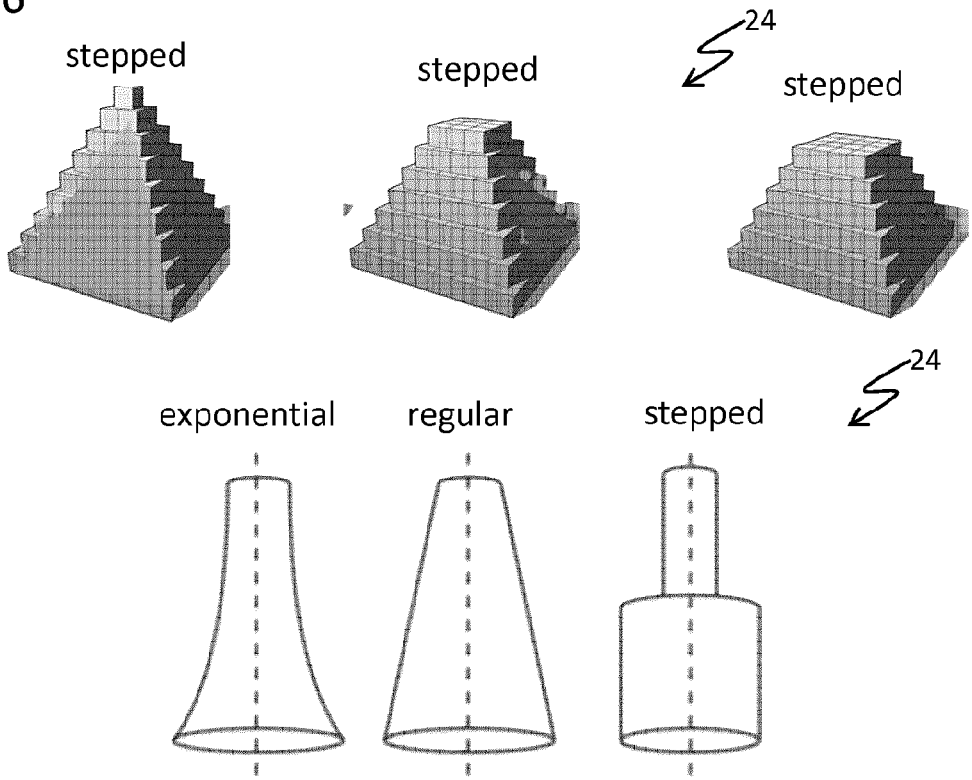
FIG. 16 shows examples of a stepped shape for a tapered vault of the devices shown in FIGS. 1-9.

The tapered vault contains the buoyant actuator in its buoyant position. The shape of the tapered vault is shown as a regular cone in FIGS. 1 to 9; however the shape of the tapered vault may be varied as desired to accommodate any regular or irregular shape with an identifiable base and apex. The shape of the tapered vault includes any three-dimensional shape that looks like a cone, a wedge (see FIG. 11), a dome (see FIG. 12), a partial barrel or pipe (see FIG. 13), a cupola (see FIG. 14), an anticupola (see FIG. 15), and the like, and can include for example, any conical, frustoconical, pyramidal (see FIG. 10A), or frusto-pyramidal (see FIG. 10B) shape. The tapered vault is characterized by a base and an apex with the base having a larger circumference or perimeter than the apex, and one or more sidewalls extending between the base and apex tapering from the base to the apex. A regular cone shape may be considered a single sidewall, while a regular pyramid shape may be considered as having multiple sidewalls. The tapering profile of the tapered vault may also be observed as tapering of sidewalls towards a central axis of the tapered vault in a direction extending from the base to the apex, the central axis of the tapered vault passing through both a center of the apex and a center of the base. An interior angle formed between a central axis of a tapered vault and a tapering side wall need not be identical at all parts of a sidewall and may vary at different portions of a sidewall. The tapering profile need not be smooth and may be stepped (see FIG. 16), for example as known for a ziggurat shape.

The central axis may of the tapered vault be perpendicular or non-perpendicular (oblique or slanted; an acute or obtuse angle) to the base. However, as mentioned below there is a benefit to the axis of the water channel passing through an aperture located at a truncated apex.

In a tapered vault shape, the radius decreases as measured along axial length when moving from base to apex. The radius from central axis to one or more sidewalls need not be uniform at a given point at the axis.

A center of the apex of the tapered vault is often substantially co-axial with an axis of the water channel, but deviation from co-axial alignment of up to +/−35 degrees may be accommodated. Typically deviation from co-axial alignment will be less than 30 degrees. In other example, deviation from co-axial alignment will be less than 25 degrees, less than 20 degrees, less than 15 degrees, less than 10 degrees, or less than any angle therebetween.

The tapered vault/cavity formed by the first compartment will have a first aperture at the base and a second aperture formed in a sidewall and/or apex location of the tapered vault, the first aperture communicative with the second chamber/cavity formed by the second compartment, the second aperture communicative with an exterior of the toilet cleaner device. The first aperture may be varied in size and may define an area that is a part or all of the base of the tapered vault. Similarly, size of the second aperture may be varied.

The apex may be a point, a line (an edge), or a face. Geometrically, a point apex may be considered a collapse of a line/edge apex which in turn may be considered a collapse of a face apex. Considered alternatively from an expansion perspective, the face apex is a geometric expansion of a line/edge apex which in turn is a geometric expansion of a point apex. The point apex, line/edge apex or face apex may be closed or formed with an opening or aperture as desired. A face apex may be considered a truncated apex.

Whether the apex is a point apex, a line/edge apex, or a face apex, a radial cross-section area of the apex will typically have at least one dimension smaller than the largest dimension of a radial cross-section area of the buoyant actuator. This relationship will be self-evident for a point apex or a line/edge apex because a point or line/edge will be narrower than available sizes of buoyant actuators. However, a face apex (observed as a truncated apex), depending on the amount of truncation, may have a radial-cross section area that may be selected to be larger than a radial cross-section area of the buoyant actuator, and in this regard adherence to a relationship of the radial cross-section area of the face apex having at least one dimension that is smaller than the largest dimension of the radial cross-section area of the buoyant actuator will benefit alignment of the buoyant actuator with the apex in a buoyant position.

In a frustum or truncated shape the apex presents as a surface or face with an identifiable area, and the center of the apex is the center of the surface or face regardless of whether the face is closed, partially open or fully open. The center of the apex will often be vertically aligned with the center of the base, but deviation from a vertical alignment to an oblique alignment can be accommodated. Similar considerations apply for a line/edge apex or point apex.

The base and apex need not be parallel as in a regular frustum and an irregular base and/or apex is possible. The base may have a grade such as a constant decline/incline or may have variations in incline/decline angles at one or more points along the area and/or perimeter of the base. Similarly, a truncated apex may have a grade such as a constant decline/incline or may have variations in incline/decline angles at one or more points along the area and/or perimeter of the truncated apex. Irregular shapes of base and or truncated apex may occur independently or may be formed dependent or consistent with each other as desired.

The first inlet, provided as an aperture communicative with the tapered vault, may be placed in any face forming the tapered interior cavity, but benefits will accrue if positioning/location of the aperture is such that the central axis of the water channel may pass through the aperture.

The outside shape of the first compartment need not follow the shape of the tapered vault and may be any different tapered shape or even a shape that is not tapered. Examples of shapes that are not tapered may be any regular prism, column, cylinder, cube and the like.

Positions of the buoyant actuator may be contrasted as a buoyant position and a dropped/fallen position in a water flow drive mechanism occurring during a flush event.

A resting buoyant position is a resting/passive position that effects a close position of the stopper when water levels are at a high water constant in between a toilet flush event. Dropped/fallen position occurs due to a water flow drive that reduces water levels to be lower than the first open end of the pipe such that the buoyant actuator no longer provides a buoyant force, the dropped/fallen position effecting an open position of the stopper. Positions of the buoyant actuator may be considered as: (1) a resting buoyant position that occurs during a rest phase of a flush cycle in between consecutive flush events; (2) an active buoyant position that is a transient position during water flow drive of falling or rising levels of water in the tapered vault and second chamber; (3) a dropped/fallen position that is also a transient position that starts when the buoyant actuator stops providing buoyant force and ends when the buoyant actuator reinitiates buoyancy as a result of water levels during a water flow drive occurring during a toilet flush event.

Buoyant support provides a support vector that counteracts a load vector (the load vector directed in the direction of the gravity vector) occurring as a result of gravity on the stopper load. The buoyant actuator is selected to have a density lesser than a density of water and when the device is filled with water the buoyant actuator provides a buoyant force with a buoyant support vector that opposes a load force exerted by the stopper with a load vector in the direction of the gravity vector. In the presence of water filling the tapered vault the support vector exerted by the buoyant actuator has a greater magnitude than a magnitude of the load vector exerted by the stopper, and thus the buoyant actuator maintains a buoyant position and tethers the stopper to a closed position blocking second open end of the pipe and blocking water flow through the water channel 48 into cleaner release chamber 28. In the absence of water in the tapered vault and optionally in a communicative interface 24*a* between the tapered vault and the cleaner concentrate chamber 26, the support vector exerted by the buoyant actuator 60 has a lesser magnitude than a magnitude of the load vector exerted by the stopper 64, and thus the buoyant actuator drops to a fallen position and the stopper also falls to an open position clearing second open end 52 and releasing dissolved cleaner concentrate through the water channel 48 into cleaner release chamber 28.

Cleaner concentrate may be any solid, semi-fluid or semi-solid such as powder, gel, paste, cake, granules, and the like. At the end of the cleaning life span of the device, the cleaner concentrate will typically be in liquid form in the second chamber.

Components of the device and any combination of components of the device may be manufactured separately or may be formed integrally as may be suited to a specific implementation. For example, the first and second compartments may be manufactured integrally (not shown) or separately as shown. As another example, the pipe may be a separate component from the first barrier (not shown) or the pipe may be formed integrally with the first barrier as shown.

The container and other components of the device may be constructed from any water impermeable material any water stable material, such as plastic polymers, glass, stone and metal materials, as may be suited to a specific implementation.

The container and other components of the device may accommodate variation in dimensions and relative dimensional differences as may be suited to a specific implementation.

The container exterior and the interior chambers defined therein may be any desired shape including columnar or tubular, conical or pyramidal, cubic, prismatic, or any irregular shape to present a customized aesthetic profile. The exterior and interior shapes need not coincide.

The buoyant actuator may be constructed according to any flotation member production technique, such as may be known in the toilet industry or the fishing industry. Various examples of the buoyant actuator include a sealed plastic body containing gas or a sealed bladder containing a gas. Also, a convenient source of material for a buoyant actuator is synthetic polymer foam such as polystyrene or polyurethane foam. An advantage of polymer foam is that entrapped gas remains contained as compared to risk of gas leakage from a bladder or a plastic ball.

The tether may be any water stable or water resistant material, and may be as rigid or flexible as desired, and further may be as elastic or non-elastic as desired. The tether may comprise different portions or linkages that are made of the same or different materials. Different portions or linkages of the tether may be coupled in any convenient manner, including hinged coupling, integrated coupling, clipped or crimped coupling, and the like. The auxiliary tether may be similarly varied. The tether does not vary from a location within the water channel defined by the pipe, and regardless of variation in number of linkages or variation in material properties of linkages the tether will be slidably received in the first open end of the pipe and slidably received in the water channel and slidably received in the second open end of the pipe.

The stopper may be made of water stable and water resistant material that is known to be used for preventing liquid leakage, such as may be known in gaskets and valves and closures of liquid containers. Examples of materials for stopper include rubber, silicone, metal, cork, neoprene, fiberglass, polytetrafluoroethylene, any suitable plastic polymer, and the like. The stopper will be sized and shaped to correspond to a size and shape of the second open end so as to block water flow through the water channel when the stopper is in a closed position. Similar considerations apply to the auxiliary stopper and the auxiliary water channel.

When the device includes an adjustable tapered vault, the volume of the tapered vault may be adjusted through any convenient mechanism that changes the distance between the apex and the first open end of the pipe. Two mechanisms have been described above. Further examples include accordion configuration or telescopic configuration of the tapered sidewalls or sidewalls at the base of the tapered sidewalls.

The device may be configured with a hanger to hang from a cistern rim or a base to receive abutting support from the cistern floor, or a combination of both as desired.

Directional terms such as top, bottom, above and below are intended to reference positional relationships as observed when the toilet cleaner device is in an operational orientation. Axial cross-sections and radial cross-sections are referenced to an axial aspect or radial aspect of the device when the axial aspect or radial aspect of a specific component is not self-evident. An axial cross-section is a cross-section plane that is parallel to an axis and often will encompass the axis within the axial plane, while a radial cross-section plane is perpendicular to the axis and crosses a single point of the axis.

Embodiments described herein are intended for illustrative purposes without any intended loss of generality. Still further variants, modifications and combinations thereof are contemplated and will be recognized by the person of skill in the art. Accordingly, the foregoing detailed description is not intended to limit scope, applicability, or configuration of claimed subject matter.

What is claimed is:

1. A toilet cleaner device comprising:

a container defining a serial communication of an interior first chamber, an interior second chamber, and an interior third chamber, the first chamber communicative with the second chamber, the second chamber communicative with the third chamber through a gap in a first barrier, the second chamber storing a cleaner concentrate;

a first inlet communicative with a first exterior surface of the container and the first chamber, and a first outlet communicative with a second exterior surface of the container and the third chamber;

the first chamber formed as a tapered vault defined by a base, an apex and an axis passing through a center of the base and a center of the apex, the tapered vault formed by one or more tapered sidewalls sloping towards the axis of the tapered vault in a direction extending from the base to the apex;

a pipe extending from the gap in the first barrier, the pipe defining a lumen forming a water channel extending between opposing first and second open ends of the pipe, the first open end located proximal to the first chamber and the second open end located proximal to the third chamber, such that the second chamber communicates with the third chamber through the water channel only;

an axis of the water channel aligned to have less than 30 degrees of an angle of deviation from a co-axial alignment with the center of the apex of the tapered vault, the angle of deviation determined as an interior angle between the axis of the water channel and a linear line extending from the center of the apex to the axis of the water channel at the first open end of the pipe; and a buoyant actuator coupled by a tether to a stopper, the tether disposed within the water channel, the tether having an axial length greater than an axial length of the water channel, the buoyant actuator disposed proximal to the first open end of the pipe and the stopper disposed proximal to the second open end of the pipe.

2. The device of claim 1, wherein the water channel is co-axially aligned with the center of the apex.

3. The device of claim 1, wherein the first inlet is formed in the apex.

4. The device of claim 1, further comprising one or more side pipe openings formed in the pipe proximal to the first open end of the pipe, the one or more side pipe openings communicative between the water channel and the second chamber.

5. The device of claim 1, further comprising a divider screen positioned proximal to the first open end of the pipe, the divider screen comprising a plurality of divider apertures radially spaced from the axis of the water channel.

6. The device of claim 5, wherein the divider screen is coupled to the pipe.

7. The device of claim 1, wherein the tether coupling of the buoyant actuator to the stopper includes at least one hinge joint supporting rotation of the tether relative to at least one of the buoyant actuator and stopper.

8. The device of claim 1, further comprising a fourth chamber disposed at a base of the container, the fourth chamber storing a weighted material providing ballast.

9. The device of claim 1, wherein the volume of the tapered vault is adjustable.

10. The device of claim 9, further comprising a tapered cap coupled to the one or more tapered sidewalls by a bolt for adjusted spacing between the tapered cap and the one or more tapered sidewalls, the tapered cap having a similar tapered profile as the one or more tapered sidewalls.

11. A toilet cleaner device comprising:

a container defining a first chamber and a second chamber, the first chamber communicative with the second chamber, the second chamber storing a cleaner concentrate;

the first chamber formed as a tapered vault defined by a base, an apex and an axis passing through a center of the base and a center of the apex, the tapered vault formed by one or more tapered sidewalls sloping towards the axis of the tapered vault in a direction extending from the base to the apex;

a first inlet communicative with the first chamber, the first inlet formed at or proximal to the apex;

the second chamber having a first end communicative with the first chamber and a second end enclosed by a first barrier defining a gap;

a pipe extending from and sealing the gap in the first barrier, the pipe forming a water channel extending between opposing first and second open ends of the pipe, the first open end located at or proximal to the first end of the second chamber and the second open end located at or proximal to the second end of the second chamber; and a buoyant actuator coupled by a tether to a stopper, the tether disposed within the water channel, the buoyant actuator disposed proximal to the first open end of the pipe and the stopper disposed proximal to the second open end of the pipe.

12. The device of claim 11, wherein the container defines a third chamber, the water channel communicative between the third chamber and the second chamber, a first outlet formed in the container communicative with the third chamber, the first inlet communicative between a first exterior surface of the container and the first chamber, and the first outlet communicative between a second exterior surface of the container and the third chamber.

13. The device of claim 12, wherein the container defines a fourth chamber, the fourth chamber disposed at a base of the container, the fourth chamber storing a weighted material providing ballast.

14. The device of claim 11, wherein the water channel is co-axially aligned with the center of the apex.

15. The device of claim 11, wherein the first inlet is formed in the apex.

16. The device of claim 11, further comprising one or more side pipe openings formed in the pipe proximal to the first open end of the pipe, the one or more side pipe openings communicative between the water channel and the second chamber.

17. The device of claim 11, further comprising a divider screen positioned proximal to the first open end of the pipe, the divider screen comprising a plurality of divider apertures radially spaced from the axis of the water channel.

18. The device of claim 11, wherein the tether coupling of the buoyant actuator to the stopper includes at least one hinge joint supporting rotation of the tether relative to at least one of the buoyant actuator and stopper.

19. The device of claim 11, wherein the volume of the tapered vault is adjustable.

* * * * *